US005917288A

United States Patent [19]

Feldman et al.

[11] Patent Number: 5,917,288

[45] Date of Patent: Jun. 29, 1999

[54] SOUND RESPONSIVE ELECTROLUMINESCENT VISUAL DISPLAY

[76] Inventors: Harold Feldman, 137-47 76th Ave., Flushing, N.Y. 11367; Yoel Ganor, #2 Shemariahu Levine Str., Jerusalem, Israel

[21] Appl. No.: 08/872,943

[22] Filed: Jun. 11, 1997

[51] Int. Cl.[6] ..... G08B 5/36

[52] U.S. Cl. ..... 315/169.3; 381/58; 340/815.46

[58] Field of Search ..... 340/815.46; 381/58; 315/169.3; 84/464 R

[56] References Cited

U.S. PATENT DOCUMENTS

| | | | |
|---|---|---|---|
| 1,690,279 | 11/1928 | Craft | 84/464 R X |
| 2,684,450 | 7/1954 | Meger et al. | 313/108 |
| 2,810,883 | 10/1957 | Carnine | 84/464 R X |
| 2,838,715 | 6/1958 | Payne | 315/108 |
| 3,052,812 | 9/1962 | Dow | 313/108 |
| 3,069,579 | 12/1962 | Berg et al. | 313/108 |
| 3,371,243 | 2/1968 | Bramley et al. | 315/169.3 |
| 3,571,647 | 3/1971 | Robinson | 313/108 |
| 3,792,308 | 2/1974 | Ota | 315/150 |
| 3,819,973 | 6/1974 | Hosford | 313/498 |
| 3,829,856 | 8/1974 | Conroy et al. | 340/815.46 X |
| 4,020,389 | 4/1977 | Dickson et al. | 315/246 |
| 4,185,276 | 1/1980 | Benson | 340/815.46 |
| 4,855,190 | 8/1989 | Bezner | 428/690 |
| 5,434,013 | 7/1995 | Fernandez | 313/504 X |
| 5,461,188 | 10/1995 | Drago et al. | 84/464 R X |
| 5,485,355 | 1/1996 | Voskoboinik | 362/84 |

FOREIGN PATENT DOCUMENTS 3742412 6/1989 Germany .

*Primary Examiner*—Robert Pascal
*Assistant Examiner*—Justin P. Bettendorf
*Attorney, Agent, or Firm*—Abelman, Frayne & Schwab

[57] ABSTRACT

A visual display is disclosed which includes a flexible elongated electroluminescent light source, whose emitted light varies in accordance with an electrical signal applied thereto, and is connected to the output of an audio output amplifier. The particular characteristics of the light emitted by the electroluminescent light source, such as color and brightness, will vary in accordance with the frequency and output of the audio signal applied thereto. Hence, the electroluminescent light source will provide a visual display which is instantaneously representative of the output signal of the audio amplifier. The electroluminescent light source may be used to provide a low interference connection between the audio output signal and earphones, such as typically used in a personal audio player.

3 Claims, 2 Drawing Sheets

FIG. 6
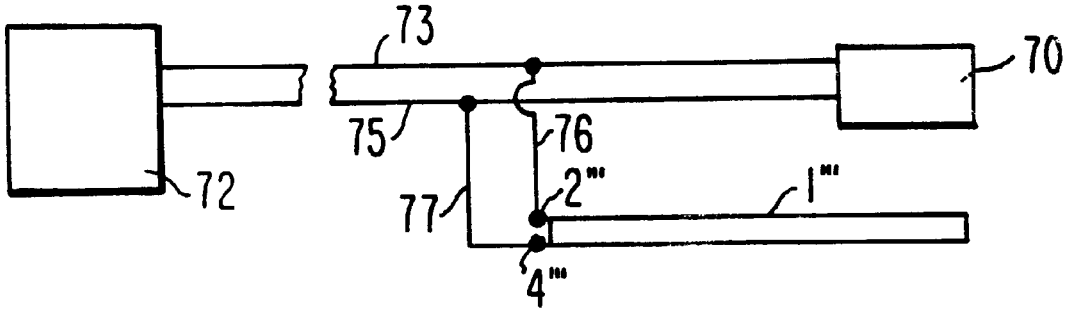
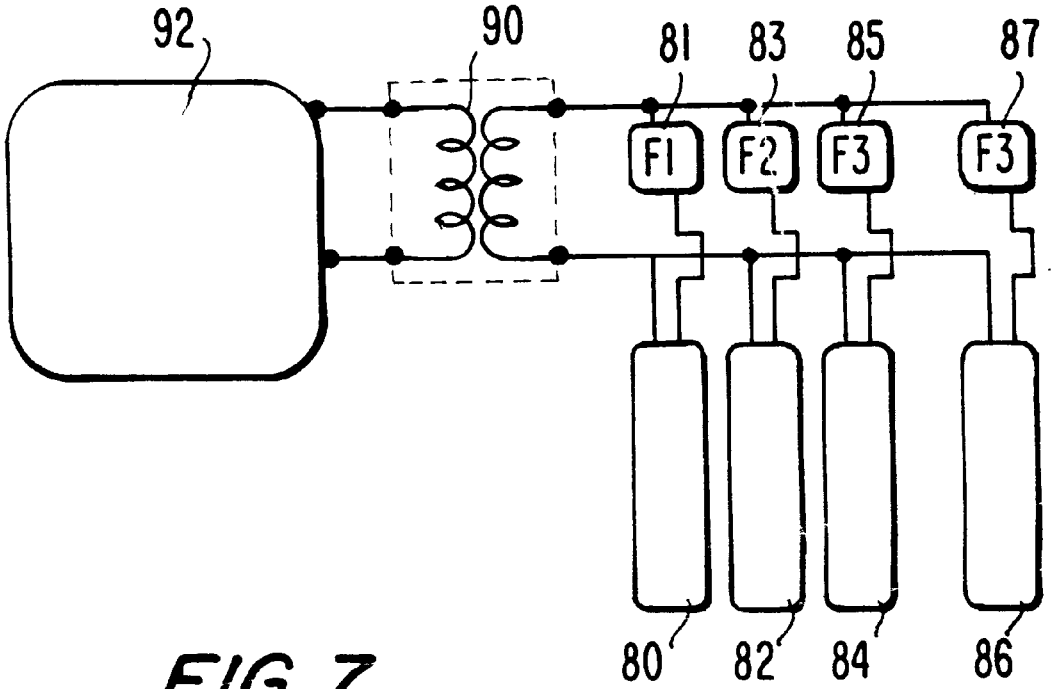
FIG. 7

SOUND RESPONSIVE ELECTROLUMINESCENT VISUAL DISPLAY

The present invention relates to the utilization of an electroluminescent light source to provide a variable visual display, which is instantaneously related to the characteristics of an applied audio signal. The electroluminescent light source, which is connected to the output terminals of an audio output amplifier, is characterized as providing an electroluminescent display which varies in color and/or brightness in accordance with the frequency and/or level of the applied audio signal.

BACKGROUND OF THE INVENTION

Various electroluminescent phosphors are known to exhibit luminescence in the presence of an appropriate electrical field. For example, if the electroluminescent phosphors are positioned in a fluctuating electrical field, such as between a pair of conductors connected to an alternating current power source, the phosphors will be excited to luminescence, with the color of the emitted light being dependent essentially on the type of electroluminophor powder utilized in the electroluminescent light source. While various configurations of electroluminescent light sources have been disclosed in the prior art, a particularly advantageous, compact, and versatile electroluminescent light source is the subject of U.S. Pat. No. 5,485,355. That patent discloses various embodiments of a flexible elongated electroluminescent light source which comprises at least two electrodes mutually disposed in such a way as to create an electric field between them when a voltage is applied thereto. At least one type of pulverulent electroluminophor is dispersed in a dialectic binder and disposed in such proximity to the applied electric field created to emit light of a specific color. A transparent columnar sheath encases the electrodes and electroluminophor. When is desired to emit a light of a particular color, according to the aforementioned U.S. Pat. No. 5,485,355 the appropriate electroluminophor powder is selected, which is known to emit the desired color, upon suitable electrical excitation. While it is also known that the hue, saturation and brightness of the color can be continuously changed by adjusting the amplitude and frequency of the voltage applied to the electrodes, it has not previously been appreciated that the electroluminescent wire can be utilized to provide a variable visual signal, representative of, and simultaneously with the output of an audio amplifier.

SUMMARY OF THE INVENTION

The present invention provides in combination a flexible elongated electroluminescent light source, typically of the type which is disclosed in U.S. Pat. No. 5,485,355, in conjunction with an audio output amplifier. The electroluminescent light source is characterized as emitting a variable light upon the application thereto of an electrical signal, with the characteristics of the emitted light varying with the variation and the parameters with the electrical signal. The electroluminescent light source will typically be connected to the audio output an amplifier in conjunction with speakers, such that a simultaneous visual and audio presentation will be provided in accordance with the instantaneous variation in the characteristics of the audio output. For example, it has been determined that an increase in frequency can result in a shift in the light emission spectrum towards the higher end. Hence, an electroluminescent light source which emits green at low frequencies will change to blue at frequencies of above 1,500 cycles. Similarly another luminescent light source which normally emits a yellow color will change to white at the higher frequency range.

An audio amplifier, intended for driving speakers normally has a frequency range between 20 and 20,000 cycles. This frequency range encompasses the working range for typical electroluminescent light sources and can be used to excite the electroluminescent light source, this will have the effect of a change in color coordinated with the change in frequency of the audio output.

Oftentimes the typical audio amplifier may not have a sufficiently high voltage at its speaker output to excite the electroluminescent light source. In those situations, a step-up transformer may be interposed between the output terminals of the audio amplifier and input terminals of the electroluminescent light source. It should be recognized, however, that when used in those audio systems which have a suitable output to excite the electroluminescent light source, the step-up transformer may be deleted. In such a system, the electroluminescent members may be used to connect the audio output to speakers, which may comprise earphones.

In one particularly advantageous embodiment, the electroluminescent light sources may be used to connect the audio output of a personal audio player (such as a Walkman, or Diskman) to earphones worn by the user. It has been found that virtually no interference will be contributed by such a connection, since the audio output has an inductive load characteristic, while the electroluminescent fiber presents a capacitive load characteristics having a very low current consumption (e.g., less than 0.1 m A/foot). Accordingly, the audio signal will not suffer from deleterious distortion resulting from the electroluminescent light source intermediary connection.

As a further embodiment, a plurality of electroluminescent light sources may be connected to the audio output terminals, each of which has a different color emission. In such an arrangement a plurality of individual band pass filters may be connected between the output terminals of the audio amplifier and the plurality of electroluminescent light sources, with each of the band pass filters having a different band width within the audio frequency range. This will result in a visual electroluminescent light source equalizer.

Accordingly, an object of the present invention is to connect an electroluminescent light source to the output terminals of an audio output amplifier, such that the electroluminescent light source will emit a variable light representative of the audio output.

Another object of the present invention is to provide such an electroluminescent light source in conjunction with an audio output amplifier, in which the color of the visual display provided by the electroluminescent light source instantaneously varies in accordance with the frequency output of the audio output amplifier.

A further object of the present invention is to provide in combination, an electroluminescent light source and an audio output amplifier, in which the electroluminescent light source presents a visual signal which varies in accordance with the frequency and intensity of the audio output signal.

Yet another object of the present invention is to utilize a flexible elongated light source to connect the audio output to earphone speakers which may be connected to a personal audio player.

Still a further object of the present invention is to connect the electroluminescent light source to a telephone excitation signal.

Yet a further object of the present invention is to provide a plurality of electroluminescent light sources, each presenting a different color upon suitable excitation, in conjunction with a plurality of intermediary band pass filters each of which having a different band width within the audio frequency range.

These as well as other objects of the present invention will become apparent upon review of the following drawings and detailed description.

BRIEF DESCRIPTION OF THE DRAWINGS

FIGS. 5 and 6 are a further alternative circuits in accordance with the present invention.

FIG. 7 is a further alternative circuit which utilizes a plurality of electroluminescent light sources in conjunction with a plurality of band pass filters to provide a multiple color electroluminescent light source equalizer.

DETAILED DESCRIPTION

Figure 1:
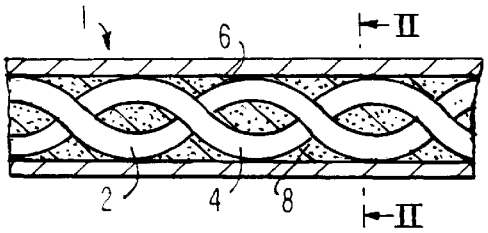
FIG. 1 PRIOR ART
FIG. 1 is longitudinal cross sectional view of one form of an electroluminescent light source that can be utilized in conjunction with the present invention.
Figure 2:
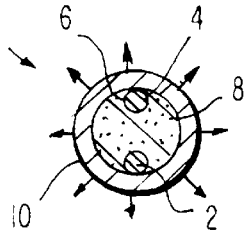
FIG. 2 PRIOR ART
FIG. 2 is a cross sectional view of FIG. 1 along the lines II—II as shown by the arrows.

Referring initially to FIGS. 1 and 2, there is shown one form of an electroluminescent light source, as disclosed in the aforementioned U.S. Pat. No. 5,485,355, that may be utilized in conjunction with the present invention. The electroluminescent light source 1 is in the form of a longitudinally extending cable which incorporates a twisted pair of electrodes 2 and 4, typically made of copper wire which may be 0.1–0.3 mm. in diameter. It is covered with a layer of insulating lacquer 6, with the electrodes 2 and 4 being twisted around each other, typically with a twisting pitch in the order of 8–10 turns per cm. The helical hollows formed between the twisted wires are filled with an electroluminescent material 8, which may typically comprise an electroluminophor powder dispersed in epoxy resin. A flexible transparent layer 10, which may typically be polyvinyl chloride of 0.5–0.6 mm. thick is then encased about the electroluminescent light source. The resulting elongated product is compact, flexible and easily shapable into different configurations. As is well known in the art, the color of the light which will be emitted by electroluminescent light source 1 is significantly dependent on the type of electroluminophor powder 8 selected. As discussed in the aforementioned U.S. Pat. No. 5,485,335 different electroluminophor powders may typically principally emit red, green, or blue light when excited by an appropriate electrical source.

To render the structure 1 operative as a light source an AC voltage of a frequency range, typically in the order of 50–20,000 cycles, and generally in the order of least 100 volts, is applied to electrodes 2 and 4 from an appropriate power source. We have recognized that since the audio power is generally within the frequency range required to activate the electroluminescent light source the audio output signal of a suitable audio amplifier may be connected to electrodes 2 and 4 to activate the electroluminescent light source 1. Further, we have discovered that the characteristics of the particular light emitted by a single electroluminescent light source 1 will vary in accordance with the parameters of the audio output signal. More specifically, the color will vary in accordance with the frequency applied, and the intensity, or brightness, will vary in accordance with the amplitude of the signal applied. Hence, by connecting an electroluminescent light source, such as 1, to the output of an audio amplifier having suitable characteristics to drive the electroluminescent power source, a visual display is presented by the electroluminescent light source which is instantaneously representative of the audio signal. Accordingly, should both an audio transducer, such as a loudspeaker and/or earphones, and the electroluminescent light source be connected to the output of the audio amplifier there will be a dual presentation of the audio transducers's audio output, and a synchronous visual representation of the electroluminescent member.

Figure 3:
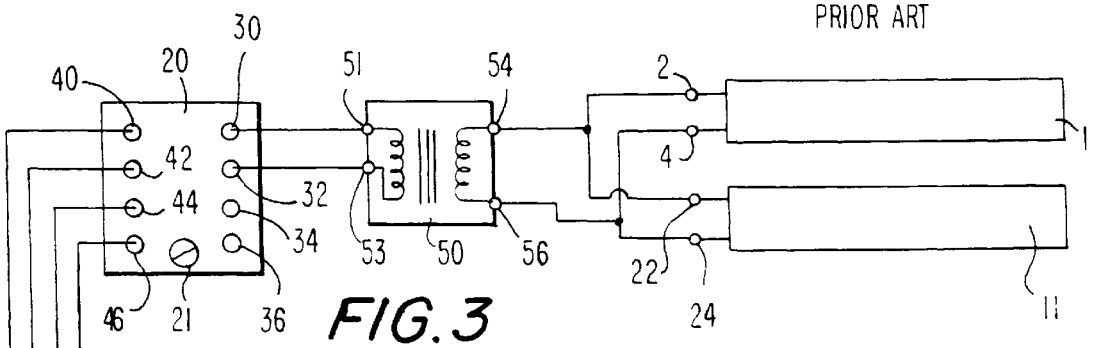
FIG. 3 is a typical circuit diagram, in accordance with the present invention, showing the electrical connection of a pair of electroluminescent light sources to the audio output amplifier.

FIG. 3 shows a typical electrical circuit in accordance with the present invention. Stereo type audio amplifier 20 includes a volume control 21 and two pair of speaker output terminals; 30, 32, 34, 36 and 40, 42, 44, 46. A pair of speakers 41, 43 are connected to terminals 40, 42, 44, 46 in the well known manner to provide the user with the audio output of amplifier 20. In accordance with the present invention, at least one of the other terminals, 30, 32, is connected to a pair of electroluminescent light sources 1 and 11. Although two such electroluminescent lights sources are shown in FIG. 3, alternatively one, or more than two light sources, may be connected, in accordance with the particular visual display desired. Electroluminescent light source 11 may generally correspond with 1, except that the electroluminophor powder may be different so as to provide a different color variation in accordance with the output signal of audio amplifier.

In those situations where the output of the audio amplifier 20 may not be sufficient to drive the electroluminescent light sources 1, 11, a step-up transformer 50 is connected therebetween. Its input terminals 51, 53 are connected to audio output terminals 30, 32. Likewise, the output terminals 54, 56 are connected to input terminals 2, 4 and 22, 24 of the electroluminescent light sources 1 and 11. The output voltage at terminals 54, 56 may typically be stepped up in the order to be in order of 100–150 volts, sufficient to drive the electroluminescent light sources 1 and 11. Selection of the particular transformation ratio will depend on the particular audio system, and electroluminescent light sources for the specific application.

It has been observed that the visual signals provided by electroluminescent 1 and 11 will synchronously vary accordance with the audio signal. Typically an increase in frequency results in the light emission spectrum towards the higher end. For example if the color being emitted at the lower audio frequencies is green, it will gradually change to blue at a frequency above 1,500 cycles. Similarly, an electroluminescent light source which emits yellow color at the lower audio frequency, will gradually change to white at higher frequencies.

Figure 4:
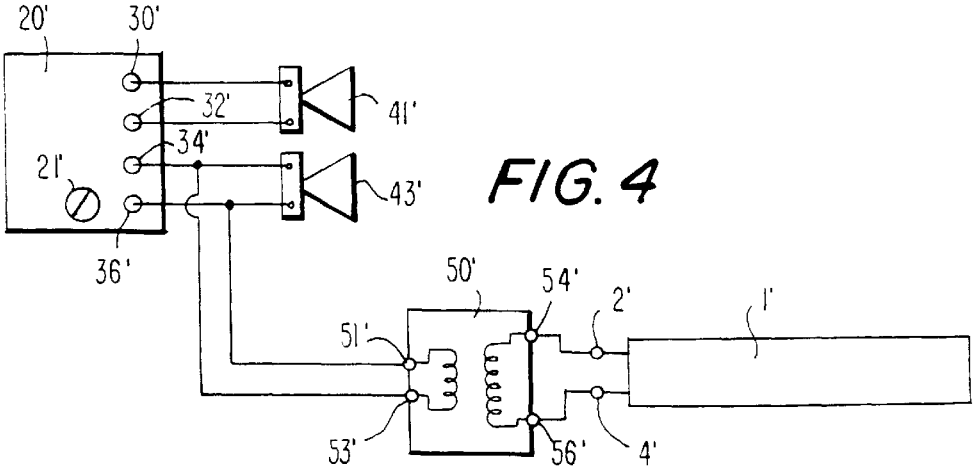
FIG. 4 is an alternative circuit diagram of another connection of the electroluminescent light source to the audio amplifier.

Reference is made to FIG. 4 which shows an alternative circuit arrangement in which those components which correspond to FIG. 3 are similarly indicated with prime numbers. The amplifier 20' differs from amplifier 20, in that it only includes one pair of audio output terminals. There is not another set of terminals (such as 40, 42, 44, 46 of FIG. 3) for connection to the electroluminescent light source. The electroluminescent light source 1', as shown in FIG. 4, is connected to one of the pair of audio output terminals (34', 36') to which one of the speakers (43') is also connected. The parallel connection to speaker 43' is in turn connected to the intermediary step-up transformer 50', whose output terminals 54', 56', are connected to terminals 2', 4' of the electroluminescent light source 1'. Should it be desired to connect a second electroluminescent light source (such as 11 of FIG. 3) it can either also be connected to the output terminals 54', 56', or independently in parallel with speaker 41' by connection to audio output terminals 30', 32'.

Figure 5:
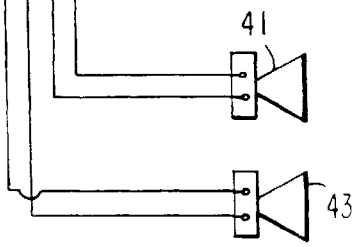
Figure 5:
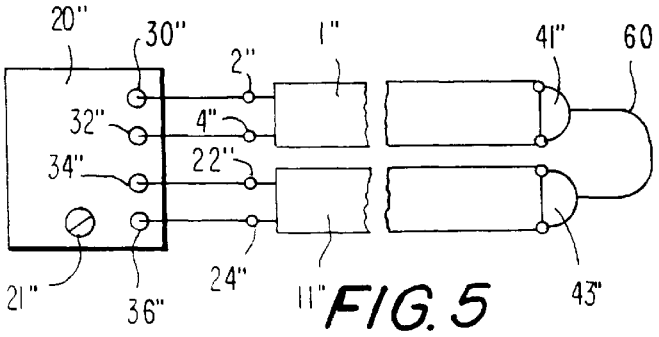

FIG. 5 shows an alternate embodiment in which those components which correspond to FIG. 3 or 4 are shown as double prime numbers. Amplifier 20" may typically be a personal audio player (such as a Walkman) having headset 60 with earphones 41", 43". By selecting an electroluminescent light source which can be driven by amplifier 20", elements 1", 11" provide the connection to the earphones 41", 43". If necessary, a miniature step-up transformer (not shown) may be interposed between the output of audio amplifier 20" and input connectors to the electroluminescent light sources 1", 11". Hence, the connections to the earphones 41", 43" provided by the electroluminescent light sources 1", 11" will provide a visual presentation coordinated with the audio output amplifier 20".

It should thus be appreciated that as the audio output signal (of amplifier 20, 20' or 20") is varied, simultaneously with its presentation to the speakers (41, 43, 41', 43' or 41", 43") the signal will be applied to the input terminals of the electroluminescent light source. Inasmuch we have determined that the light emitted by the electroluminescent light source will vary in both color and intensity according to the parameters of the audio output signal applied thereto, the system, as shown in FIGS. 3, 4 or 5, will provide a simultaneous audio and visual presentation of the output signal being provided by the audio amplifier.

FIG. 6 shows still another circuit in accordance with the present invention, in which the terminals 2"' and 4"' of the electroluminescent light source 1' are connected in parallel to conductors 73, 75 which connect telephone 70 to its excitation source 72. The typical telephone line signal characteristic is 50–100 VAC pulse bursts when activated by an active ringing line. This voltage will activate the electroluminescent fiber 1"', which will then be lit in synchronization with the telephone ringing sound. Fiber 1"' may be physically incorporated in the same transparent insulation jacket as the connecting telephone cord for conductors 73, 73 to therefor require only one connecting cable.

FIG. 7 shows still another circuit arrangement in accordance with the present invention in which a plurality of electroluminescent light sources 80, 82, 84, 86 are connected in parallel to the output of step-up transformer 90, which, in tern, is connected to the audio output source 92. Each of the electroluminescent light sources 80, 82, 84, 86 is preferably constructed so as to provide a different color light when suitably excited. In accordance with this embodiment, a plurality of band pass filters 81, 83, 85 and 87 are provided, each of which will have a different band width within the audio frequency range. Accordingly, by virtue of their intermediary connection between the audio output and the electroluminescent light sources, each of the electroluminescent light sources 80, 82, 84, and 86 will respond to a different band width, as determined by the frequency characteristics of its particular band pass filter. Thus, the system shown in FIG. 7 results in an electroluminescent fiber equalizer.

It should naturally be understood that various other modifications may be made as to the manner in which the electroluminescent light source, which is excited by the audio output provides a visually presentation. For example, electroluminescent light sources may be placed in proximity to, or even upon, a performer's clothes, so as to light up in synchronization with the performer's speech as picked up by a microphone, which will simultaneously be connected to the electroluminescent light sources. Further, inasmuch as the electroluminescent light sources are flexible they can be configured into various shapes or logos.

While several embodiments of the present invention have been discussed and described in detail, various modifications, may be made (for example other forms of the electroluminescent light source shown in U.S. Pat. No. 5,485,355, or otherwise known in the prior art, may be utilized) without departing from spirit and scope of the present invention as defined in the following claims:

We claim:

1. An audio player including an audio amplifier and an audio signal-to-sound transducer;

said audio amplifier including output terminals, with an audio signal at said output terminals;

said audio signal-to-sound transducer including input terminals;

an electrical connector between said input and output terminals, for connecting the audio signal and said audio amplifier to said transducer, with said transducer converting said audio signal to audible sound;

said connector being a flexible elongated electroluminescent light source characterized as emitting light upon the application thereto of said audio signal, with the characteristics of the emitted light varying with the parameters of the audio signal;

whereby said connector means simultaneously (i) transmits said audio signal to said transducer to provide audible sound, and (ii) emits light which varies with the parameters of the audio signal.

2. An audio player according to claim 1, wherein said transducer is provided by speakers in a personal headphone.

3. An audio player according to claim 2, which is of sufficiently small size and low weight to be a personal audio player.

* * * * *